United States Patent [19]

Schmid

[11] 4,026,552

[45] May 31, 1977

[54] BOWLING ALLEY BOWLING BALL SHOCK ABSORBER MECHANISM

[75] Inventor: August Schmid, Schwerzenbach, Switzerland

[73] Assignee: Patentverwertungs-und Finanzierungsgesellschaft Serania AG, Glarus, Switzerland

[22] Filed: June 23, 1975

[21] Appl. No.: 589,181

[30] Foreign Application Priority Data

June 27, 1974 Switzerland ..... 8825/74

[52] U.S. Cl. ..... 273/49; 273/53

[51] Int. Cl.[2] ..... A63D 5/02

[58] Field of Search ..... 273/43 R, 43 A, 49, 273/53

[56] References Cited

UNITED STATES PATENTS

| | | | |
|---|---|---|---|
| 2,815,954 | 12/1957 | Zvercher | 273/53 |
| 2,992,826 | 7/1961 | Truche | 273/53 |
| 3,103,358 | 9/1963 | Holloway | 273/49 X |
| 3,237,942 | 3/1966 | Congelli et al. | 273/49 X |
| 3,319,959 | 5/1967 | Lenhart | 273/53 |

*Primary Examiner*—Anton O. Oechsle
*Attorney, Agent, or Firm*—Flynn & Frishauf

[57] ABSTRACT

To accept the kinetic energy of moving bowling balls and stop the bowling balls, and transport them from the bowling pin pit to a return mechanism, one, and preferably two vertically staggered bumpers are provided located transversely across the bowling pit, the bumpers being movable and having a movable mass which corresponds essentially to the mass of the bowling balls; to return the bowling balls, an endless rubber belt or cable is moved transversely to the bowling pin pit, for example secured to the lower one of the bumper assemblies, to engage the bowling ball when it has impinged the bumper and is just in front thereof to move it transversely out of the way of the bowling alley pit.

19 Claims, 1 Drawing Figure

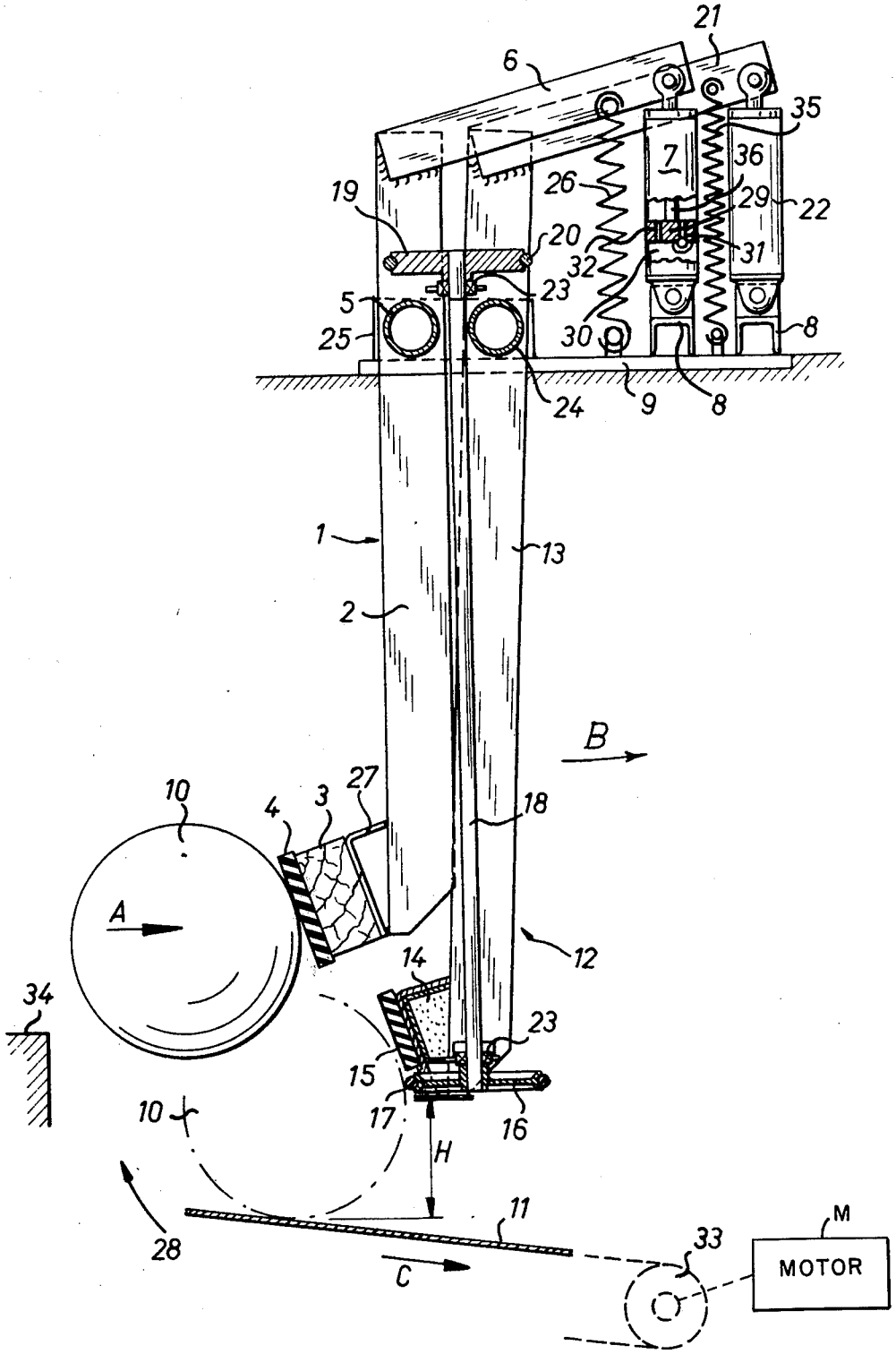
21
6
35
7
36
26
29
22
19
20
31
32
23
5
30
8
25
24
9
8
1
13
2
B
10
27
4
3
18
A
12
14
34
23
15
17
16
10
H
28
11
33
M
C
MOTOR

BOWLING ALLEY BOWLING BALL SHOCK ABSORBER MECHANISM

The present invention relates to bowling alley equipment, and more particularly to shock absorbers and braking devices to absorb the energy of a rolling bowling ball, and to control further movement thereof.

The rules of some bowling games require two successive rolls of the ball; customarily, each player uses the same ball for the consecutive rolls. It is desirable that the ball be returned to the player as rapidly as possible so that successive rolls can be carried out with little interruption.

It is an object of the present invention to control movement of the bowling ball after it has passed the bowling pin set positions, and more specifically to absorb the energy of the moving ball and rapidly direct it to a return mechanism to return the bowling ball to the player.

SUBJECT MATTER OF THE PRESENT INVENTION

Briefly, a shock absorber structure is provided which comprises a swinging mass of such mass value that it is approximately that of the customarily used bowling balls. Transport conveyor elements are provided located to engage a bowling ball and move the bowling ball transversely to the bowling alley, in order to feed the bowling ball to a ball returning mechanism.

The apparatus in accordance with the present invention is so arranged that the kinetic energy of the bowling ball which is projected by the player against the bowling pins is rapidly absorbed so that the ball itself is arrested, without bounce of the bowling ball, or ricochet thereof. The time during which a bowling ball would have returned is thus saved; by positively moving the bowling ball in a direction transverse to the bowling alley, return of the bowling ball to the player, and to the return track, is speeded, thus substantially decreasing the overall cycling time of playing a ball, that is, rolling a ball until it again returns to the player.

The invention will be described by way of example with reference to the accompanying drawings, wherein the single FIG. is a schematic side view, partly in section, illustrating the structure of the ball shock absorber and transport mechanism.

Bowling alleys have alley pits beyond the position where the pins are located. The alley is schematically indicated at 34, beyond which pit 28 is located. The apparatus in accordance with the present invention is located in the pin pit 28 and is arranged to brake the movement of bowling balls 10, and then to guide the bowling ball laterally, that is, in a direction in and out of the plane of the drawing to a suitable return conveyor, or return track. Two shock absorbers or buffers 1, 12 are located adjacent each other, one in front of the other; the shock absorbers are rotatable over horizontal shafts or axes. The first or upper buffer 1 has two arms 2 extending generally in vertical direction and located at either side of the bowling alley. The arms 2, at both sides of the alley, are connected by a transversely extending beam 3. Beam 3 thus extends approximately across the entire width of the bowling alley 34, or, across the bowling pit 34, respectively. An angle iron 27 connects beam 3 to the respective arms 2. The front side of beam 3 is protected over its entire length by a rubber strip 4, forming the actual impingement surface for the balls 10. Arms 2 are connected to a pipe 5 at their upper ends, preferably at about the upper quarter thereof, which pipe 5 is rotatably supported in bearings 25. Bearings 25 are supported on stationary support brackets 9. Each arm 2 has an angle lever 6 connected thereto, for example by welding, so as to be rigidly connected, so that arms 2 and 6 together form an angle lever. The rear end of lever 6 is connected to a tension spring 26 and to a dash pot 7. Dash pot 7 is pivotally connected to a bracket 8, secured to bracket 9 and is provided in order to dampen the rearward movement of shock absorber 1, that is, to dampen movement in direction of the arrow B. The damping system 7 comprises a cylinder in which a piston is retained by means of a pivotally mounted piston rod 36. Upon movement of arm 2 in direction of arrow B air, or a damping liquid, or other damping fluid is permitted to enter cylinder chamber 30 through an inlet valve 31. Upon return movement due to the restoring force of spring 26, the movement is damped, so that the shock absorber 1 will return to its rest position only slowly. Piston 29 is formed with a narrow cross bore 32 which throttles passage of fluid therethrough.

A second shock absorber 12 is provided, with cross elements located beneath the beam 3 of the first shock absorber 1. It is disposed slightly behind shock absorber 1 and includes two arms 13 located at either side of the bowling alley. Arms 13 are slightly offset laterally with respect to arms 2. A cross beam 14 connects arms 13. Cross beam 14 is formed with a rubber surface 15, such as a rubber strip, at the front side thereof against which the balls 10 impinge. The upper end of arms 13 is rigidly connected with a lever 21 to which a spring 35 is linked, as well as a dash pot damping arrangement 22. The dash pot 22 corresponds essentially to the dash pot 7 and a specific description thereof is therefore not necessary. It operates similarly to dash pot 7. A pipe 24 is secured to approximately the upper quarter of arms 13, journaled in bearings 25 so that pipe 24 is rotatable independent of rotation of pipe 5.

A ball transport arrangement is located beneath the cross brace or cross beam 14. It includes an endless rubber cable 17, looped about end sheaves 16, located at the lower end of the respective arms 13 of shock absorber 12. One of the sheaves 16 is connected to an approximately vertically extending shaft 18 which is rotatably secured in upper and lower bearings 23. The upper end of shaft 18 is connected to a drive pulley 19, around which a drive belt 20 is looped, driven from a motor (not shown) to provide rotation to shaft 18 and hence to move the rubber cable, or rubber belt 17 transversely to the direction of the bowling alley. The rubber belt 17 and sheaves 16 are so arranged at the lower ends of arms 13 that balls 10 which are supported on the inclined surface 11 will engage the belt 17, to be rotated and carried along thereby, so that the balls 10 will be removed at a right angle with respect to the plane of the drawing, carried by the rubber belt 17, to be transported to a ball return mechanism. Balls 10 thus are rapidly moved to a return transport conveyor and return transport track, to be returned to the players in minimum time.

The kinetic energy of the rolling balls is absorbed; the balls, thereby, are so braked that they will not bounce back. The first shock absorber 1 thus is given an effective mass which corresponds approximately to that of the balls 10. A variation of ±20% in mass between the balls 10 and the front shock absorber 1 does not greatly interfere with absorption of energy, and still provides satisfactory results. In a practical embodiment, balls having a weight of about 7.5 kg are used; the first buffer 1 has a weight of about 8.5 kg. The kinetic energy of a ball 10 impinging on the first shock absorber 1 is thus transferred to the shock absorber, so that the ball will be arrested and will not be subjected to bounce-back. Movement of the shock absorber 1 in direction of the arrow A and the oppositely directed component of motion which results from the elastic expansion of the rubber coating 4 are approximately in balance. Thus, the ball 10 drops vertically downwardly, due to its weight, to roll off on the inclined surface 11 for a short distance until, having moved in the direction of the arrow C, it is engaged by the rubber belt 17 and immediately transported transversely to the ball return mechanism, that is, in a direction transverse to the arrow A.

A second shock absorber 12 is so located that it will catch balls which run in the grooves normally formed adjacent the bowling surface itself, and to stop such balls. Its effective mass is also approximately that of the mass of the customarily used balls 10. It operates similarly to balls 10.

The clearance H between the lowest point of the second shock absorber 12 and the surface 11 is selected to correspond approximately to half the diameter of a bowling ball, and in any event is selected to be larger than the diameter of the widest bulge of the bowling pins. The bowling pins, therefore, can pass beneath the element 12, to be transported by surface 11 to a suitable bowling pin elevator.

Surface 11 may be stationary; it may, also, be formed as a movable transport web, driven by a motor M in direction of the arrow C, and looped around end rollers, one of which is shown at 33 (a complete disclosure of such a transport arrangement is shown in co-pending application entitled "Bowling Pin Transport Conveyor", by the inventor hereof; U.S. Ser. No. 589,266, filed June 23, 1975. A suitable bowling pin elevator is illustrated, for example, in the copending application by the inventor hereof, U.S. Ser. No. 589,267 filed June 23, 1975.

Various changes and modifications may be made; for example, a single shock absorber 1 is only required, so located that ball 10 can pass therebeneath after first impinging thereon. The transport systems 16, 17 to move the ball 10 transversely with respect to the bowling alley 34 can be mounted separately, for example in a fixed portion of the pit of the bowling alley.

The impingement surface 4, 15 of the shock absorbers is preferably inclined in such a manner that the impingement of the ball 10 is tangential, that is, does not leave any force components which may tend to lift or to depress the ball. To reduce noise, the beam 3 is preferably made of wood or other somewhat elastic substance; if a transverse beam 14 is used which consists entirely of metal, for example for increased strength, a sound absorbing filling is desirably added, as shown schematically by the stippled region of cross beam 14.

I claim:

1. In combination with a moving bowling ball, a bowling alley bowling ball shock absorber mechanism to accept the kinetic energy of said moving bowling ball and having a shock absorbing element (1) mounted for movement in the direction of movement of the bowling ball, and means rigidly secured to the shock absorbing element (1) temporarily storing and then dissipating kinetic energy imparted to said element upon impact with said moving ball, and subsequent deflection of said element, wherein the movable mass of the shock absorbing element (1) corresponds approximately to the mass of the bowling ball (10) so that the kinetic energy of the moving bowling ball will be transferred from the bowling ball (10) to the movable element upon impact of the bowling ball against the movable element;

and bowling ball transport means (16, 17) extending transversely to the bowling alley located to be engaged by the braked bowling ball after impact with said shock absorbing element.

2. Mechanism according to claim 1, wherein the shock absorbing element comprises two independently movable bumpers (1,12), one located in advance of the other with respect to the direction of deflecting movement, each of said bumpers having a total movable mass which approximately corresponds to at least the movable mass of the bowling balls within about 10% thereof, the rear one of said bumpers (12) being wider than the forward bumper (1).

3. Mechanism according to claim 1, wherein said shock absorbing element comprises a bumper extending transversely across the bowling alley, said bumper being formed as a beam (3, 14) having a downwardly inclined elastic impact surface (4, 15) located and angled to be approximately tangential with respect to the point of impingement of the bowling ball thereon;

and a pair of pivotally mounted arms (2, 13) disposed at either side of the bowling alley and supporting said transversely extending beam.

4. Mechanism according to claim 1, wherein the transport means (16, 17) comprises a pair of sheaves having an approximately vertical axis, and an endless elastic friction belt (17) looped about said sheaves, said friction belt extending transversely to the bowling alley, one of said sheaves being driven to provide a transversely extending driven friction belt for engagement with the bowling balls to transport the bowling balls laterally of the alley.

5. Mechanism according to claim 4, wherein the shock absorbing element (1) comprises a beam (3, 14) extending transversely of the bowling alley; lateral arms (2, 13) pivotally supporting said beam;

and said sheaves (16) being secured to said beam.

6. Mechanism according to claim 5, wherein two beams (3, 14) are provided, each one of said beams being supported by pivotally secured arms (2, 13) and being formed with impingement surfaces to be impinged by bowling balls projected thereagainst;

said beams being located in vertically staggered arrangement, and the sheaves (16) being secured to the lower one of said beams (14).

7. Mechanism according to claim 1, wherein the shock absorbing element comprises a transversely extending beam (3);

a support surface (11) for said bowling balls is provided, and wherein the clearance distance between said transversely extending beam and the support surface (11) is greater than the bowling ball diameter;

the transport means (16, 17) being located beneath and behind said beam.

8. Mechanism according to claim 1, wherein said shock absorbing element comprises transversely extending means (3, 14) and support arms (2, 13) pivotally supporting said transversely extending means;

and the energy storing and dissipating means comprises a restoring spring (26, 35) connected to said arms to resiliently hold said arms in rest position;

and a return damping dash pot (7, 22) connected to said arms.

9. Mechanism according to claim 1, wherein said shock absorbing element (1) comprises a transversely extending beam (3) consisting, at least in part, of wood.

10. Mechanism according to claim 1, further comprising a support surface (11) for the bowling balls after having impinged the shock absorbing element (1), said support surface (11) comprising a downwardly inclined motor driven movable endless web (11).

11. Mechanism according to claim 10, wherein the clearance distance (H) between the lowest point of the shock absorbing element and the support surface (11) corresponds to approximately half the diameter of a bowling ball, and is larger than the widest diameter of a bowling pin.

12. Mechanism according to claim 7, wherein the transport means (16, 17) comprises a pair of sheaves having an approximately vertical axis, and an endless elastic friction belt (17) looped about said sheaves, said friction belt extending transversely to the bowling alley, one of said sheaves being driven to provide a transversely extending driven friction belt for engagement with the bowling balls to transport the bowling balls laterally of the alley;

and means (13, 18) supporting said sheaves at a distance above the support surface (11) which correspond to approximtely half the diameter of the bowling ball, and is larger than the widest diameter of a bowlng pin.

13. Mechanism according to claim 12, wherein the support means for said sheaves comprises an independently movable bumper located, with respect to deflecting movement of said shock absorbing element, behind said shock absorbing element, said bumper being wider than said shock absorbing element (1) and, together with said sheaves (16) and belt (17) having a total movable mass which approximately corresponds to at least the movable mass of the bowling balls.

14. Mechanism according to claim 13, wherein said support surface (11) is located beneath the lowest point of said shock absorbing element (1) by a distance greater than the diameter of a bowling ball, and said bumper (13) is located vertically staggered with respect to said shock absorbing element (1).

15. Bowling alley bowling ball shock absorber mechanism to accept the kinetic energy of moving bowling balls having two shock absorbing bumpers (1, 12), one located behind the other;

energy storage and dissipating means (7, 26; 35, 29) connected to each one of said bumpers to temporarily store kinetic energy imparted to said bumpers upon impingement of a moving bowling ball therewith, and consequent deflection of the respective bumper;

said bumpers being vertically staggered with respect to each other, and each comprising a beam (3, 14) extending transversely of the bowling alley, the forward bumper having its transverse beam (3, 4) located higher than that of the rearward bumper, the rearward bumper being wider than the forward bumper and extending essentially across the entire bowling alley;

and a transport mechanism comprising a pair of sheaves having an approximately vertical axis located on the rearward one of said bumpers and an elastic friction belt (17) looped about said sheaves, said friction belt extending transversely with respect to the bowling alley, at least one of said sheaves being driven, to provide a transversely extending driven friction belt for engagement with a bowling ball projected towards said bumpers and to transport the bowling ball laterally of the alley.

16. Mechanism according to claim 15, further comprising a support surface (11) for the bowling balls after having impinged the rear, and lower one of said bumpers (12), the clearance distance (H) between the lowest point of the rear bumper and the support surface corresponding to approximately half the diameter of a bowling ball and being larger than the widest diameter of a bowling pin.

17. Mechanism according to claim 15, wherein the transversely extending beam (3) of the forward bumper (1) comprises, at least in part, a wooden beam (3).

18. Bowling alley bowling ball shock absorber mechanism to accept the kinetic energy of moving bowling balls rolling over a support surface (11, 34) having a shock absorbing bumper (12) extending transversely across the bowling alley, said bumper being formed as a beam (14) having an impact surface (15) located and angled to be approximately tangential with respect to the point of impingement of the bowling ball thereon, the clearance distance (H) between the lowest point of the bumper (12) and the support surface (11) corresponding to approximately half the diameter of a bowling ball and being larger than the widest diameter of a bowling pin;

a pair of pivotally mounted arms (13) disposed at either side of the bowling alley and supporting said transversely extending beam (14)

a restoring spring (35) connected to said arms to resiliently hold said arms (13) and hence said bumper (12) in rest position and permitting deflection by pivoting of the support arms;

a return damping dashpot (22) connected to said arms (13), said restoring spring (35) and said dashpot (22) forming, together, energy storage and dissipating means connected to said bumper (12) to temporarily store kinetic energy imparted thereto upon impingement of a moving bowling ball therewith, and consequent deflection of the bumper (12);

and bowling ball transport means including a pair of sheaves having an approximately vertical axis located on the bumper (12) and an elastic friction belt (17) looped about said sheaves, said friction belt extending transversely with respect to the bowling alley, at least one of said sheaves being driven, to provide a transversely extending driven friction belt for engagement with a bowling ball projected towards said bumper and to transport the bowling ball laterally of the alley.

19. Mechanism according to claim 18, further comprising drive means for said at least one driven sheave comprising a vertically extending drive shaft (18) extending approximately in the same direction as said support arms (13), and a drive pulley (19) secured to the upper end of the drive shaft (18) and adjacent the pivot axis (24) of the pivotally mounted arms (13).

* * * * *